US006105692A

United States Patent [19]

Clarke et al.

[11] Patent Number: 6,105,692

[45] Date of Patent: Aug. 22, 2000

[54] SWIVEL CHAMBER FOR WATER ACTUATED WIRELINE DRILLS

[75] Inventors: Dale Marvin Clarke, Sudbury; David Sean Parent, Val Caron; Robert Thom, Coniston, all of Canada

[73] Assignee: Inco Limited, Toronto, Canada

[21] Appl. No.: 09/198,685

[22] Filed: Nov. 24, 1998

[51] Int. Cl.[7] ..... E21B 25/00

[52] U.S. Cl. ..... 175/214; 175/215; 73/864.45

[58] Field of Search ..... 175/214, 215, 175/218; 166/69, 70, 77.1, 246; 73/864.44, 864.45

[56] References Cited

PUBLICATIONS

Bradley Manufacturing "Wireline Core Barrel 'Underground' Size A W/L–U" (date unknown).

*Primary Examiner*—David Bagnell
*Assistant Examiner*—Sunil Singh
*Attorney, Agent, or Firm*—Edward A. Steen

[57] ABSTRACT

A swivel chamber that streamlines the procedure for retrieving core samples from a wireline diamond core drill. The swivel chamber includes a housing, a rotary seal, overshot and wire cable packing. The swivel chamber is threaded at one end for attachment to a drill rod. The other end of the swivel chamber allows for the connection of a cable packing housing. The swivel chamber has two spaced fluid inlets to drive the drilling cycle and the core retrieval cycle. Contrary to previous designs, the swivel chamber remains in place during both cycles.

12 Claims, 2 Drawing Sheets

SWIVEL CHAMBER FOR WATER ACTUATED WIRELINE DRILLS

TECHNICAL FIELD

The instant invention relates to earth drilling techniques in general and, more particularly, to a simplified apparatus for expeditiously retrieving diamond drill core components.

BACKGROUND ART

Diamond core drilling is a well established drilling technique that produces a retrievable cylindrical rock core sample. The core sample is usually analyzed for content, physical and chemical properties and other attributes.

A drill including a surface mounted rotation unit rotates a diamond drill bit into a hole. Water is injected through the center of the drill rods of the drill string to cool the diamond cutter bits and flush cuttings away from the face. The exhausted water and cuttings flow around the exterior of the drill rod and up the hole.

A rock core is established by an inner tube disposed above the drill bit within the drill string. In order to retrieve the core, the inner core must be retracted from the drill string and brought to the surface without disturbing the existing drill string.

Conventionally, a wireline core barrel is disposed just upstream from the bit. The core barrel includes a spring loaded female latch facing back towards the drill rig. An overshot with a male spearhead is forced downwardly through the drill string where it mates with the latch. The entire combined core barrel and overshot are pulled up through the drill string by the wire. The core barrel is removed, the entrained core emptied and the barrel is reinserted. A new rod is threaded into the drill string; the core barrel forced back down through the drill string by hydraulic pressure; and the drilling cycle commences again.

More particularly, the conventional technique of retrieving diamond drill cores using the wireline system involves the removal and installation of a number of components. They consist of a high speed water swivel, loading chamber, overshot, wireline cable, cable packing, and water hoses. This process is time consuming, causes unnecessary wear, does not lend itself to the automation and is prone to safety hazards.

Presently, during the drilling cycle, the high speed water swivel and water hose are attached to a chuck rod and/or drill rod held by the rotation unit. This allows drilling water to be injected into the rotating drill rod string. When the drilling cycle has been completed the next operation is core recovery.

In this operation the water swivel and hose are disconnected from the rod and the hose is removed from the water swivel. The overshot with the wireline cable attached is then inserted inside the exposed end of the drill rod. The water hose (previously disconnected from the water swivel) is connected to loading chamber. The cable packing is then tightened onto the wireline cable. The water is turned on and the hydraulic pressure pushes the overshot and wireline down through the drill rods to retrieve the full core tube. When the core tube has been secured by the overshot, the cable is retracted and it pulls the core tube to the collar of the drill rods. The water hose, loading chamber, overshot, and cable are then removed from the drill rods, and the core tube taken out of the drill rods.

An empty core tube is then inserted into the drill rods, the water swivel is threaded onto the drill rod and the water hose reattached. The water is turned on and the pressure pushes the empty core tube down through the drill rods to its core receiving position. The next drilling cycle can now commence.

For various reasons, not the least of which is to provide a better working atmosphere, it is advantageous to operate the drills from a remote location rather than in a substantially closed working environment such as a mine. Considering the complexity of operating a diamond drill, a key function is the recovery of the drilled core. In addition it is advantageous to reduce the time spent on the addition and removal of parts. This in turn increases the time available for productive drilling. By eliminating the tedious job of manually continuously installing and removing components, productivity increases and safety concerns are alleviated.

SUMMARY OF THE INVENTION

There is provided a swivel chamber that combines the functions all of the existing components into a single unit. The swivel chamber eliminates the repetitive need for the removal or installation of parts between different operations.

The swivel chamber which is adapted to be affixed in an inline fashion to a rotation unit of a drill includes a water tight rotary union and an elongated housing. The elongated housing, adapted to accommodate an overshot, includes a drilling water inlet and a core retrieval inlet. A wire cable packing permits the wire to traverse the swivel chamber with minimal water leakage.

The swivel chamber remains in place during the drilling and core recovery cycles. As opposed to conventional practice, there is no need to uncouple and reconnect cumbersome components with loss of efficiency and safety such repeated operations entail.

PREFERRED EMBODIMENT OF THE INVENTION

Figure 1:
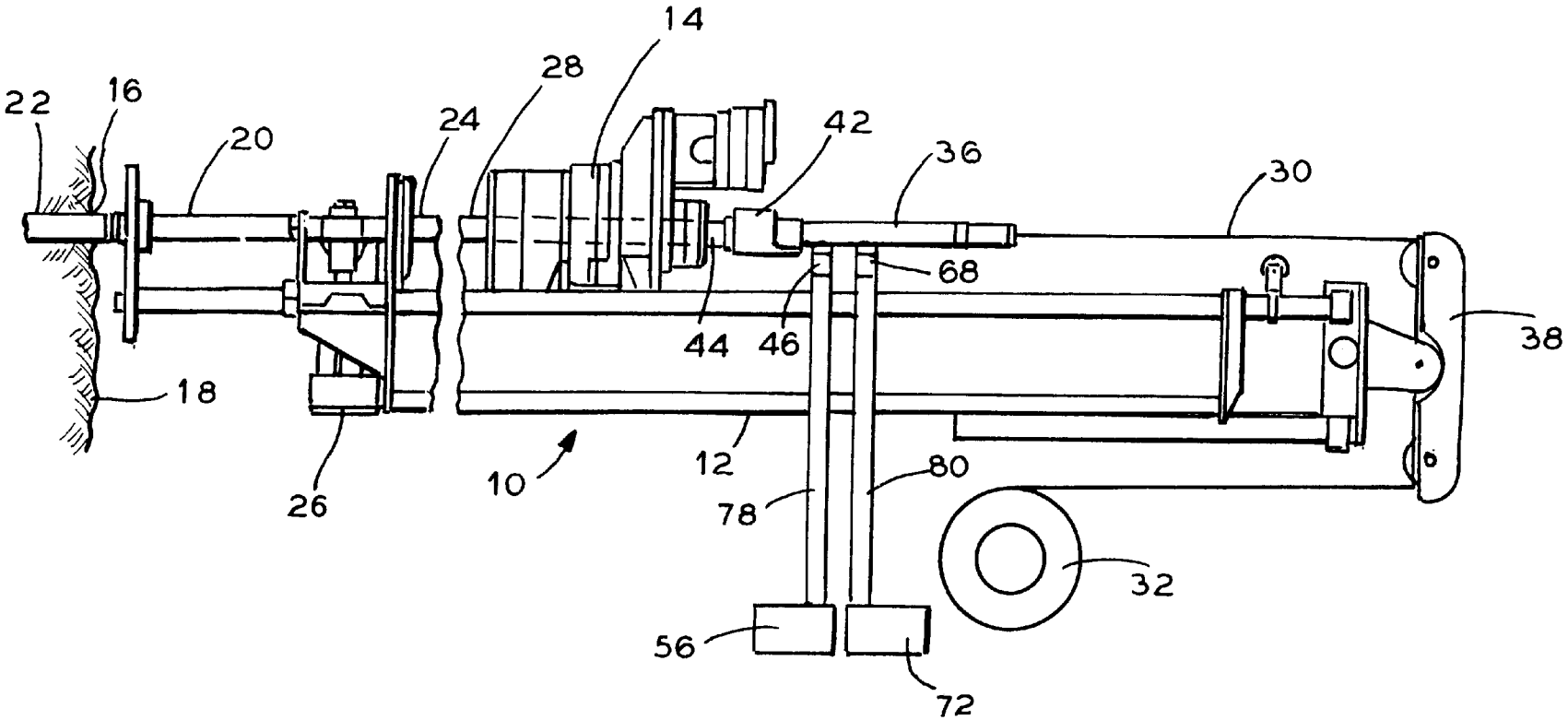
FIG. 1 is an elevation of an embodiment of the invention.

Referring to FIG. 1, there is shown a typical diamond core drill 10. For ease of discussion many of the conventional components of the drill 10 are not shown. However, the relevant structures are briefly discussed.

The drill 10 includes a robust mast 12. A rotation drive unit 14 is slideably mounted to the mast 12 and is capable of traversing the length of most of the mast 12. Diamond core drills 10 are capable of drilling in any orientation. Accordingly they may drill a hole 16 in a surface 18 in any direction.

The drill rod string 20 consists of a plurality of drill rods 22, 24 (only two are shown) threadably affixed to one another and extending into the hole 16. A rod holder 26 secures the rod 24 to the foot of the drill 10. An optional threaded chuck rod 28 serves as a bridge between the rod 24 and the rotation unit 14. Alternatively, the rod 24 may be directly affixed to the rotation unit 14. A wireline or cable 30, connected to a spool/winch combination 32, acts as a wire retriever of an overshot 34 via pulley 38.

Instead of the cumbersome conventional water swivel with its attendant unwieldy water hose, the drill 10 is shown equipped with the instant swivel chamber 36.

Figure 2:
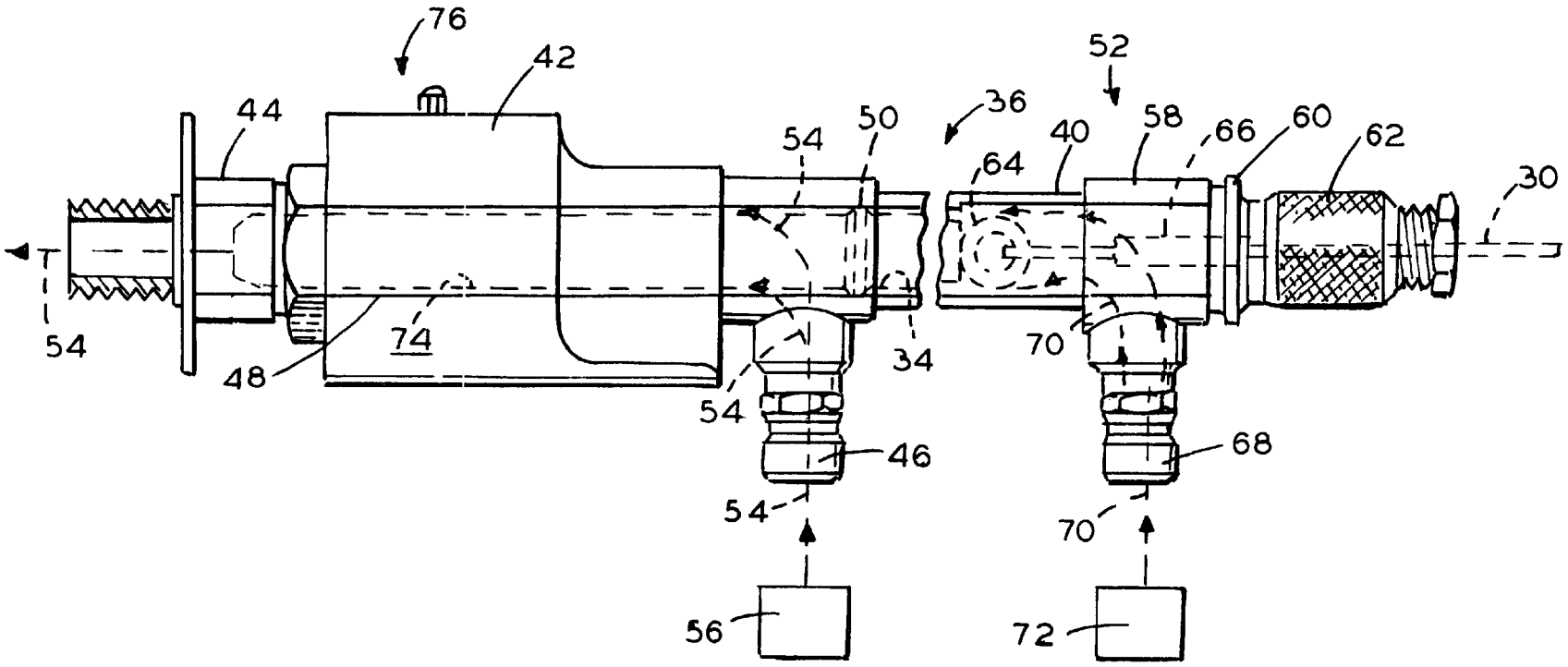
FIG. 2 is an elevation of an embodiment of the invention.

Turning now to FIG. 2, the swivel chamber 36 includes an elongated cylindrical housing 40 connected to a rotary union 42. As a non-limiting convention, the swivel chamber has a proximal end 52 and a distal end 76.

The rotary union 42, manufactured by Deublin Company of Waukegan, Ill. (series number 55, part number 655-500-124) allows for a fluid leak resistant coupling between a rotating drill rod adapter 44 and the stationary housing 40. Similar rotary/stationary fluid connectors made by other manufacturers are acceptable alternatives. The rod adapter 44 is threaded to the rotating chuck rod 28 (if used) or to the rod 24.

The hollow housing 40 includes a drilling water inlet 46 and a core retrieval inlet 68. Each inlet may be supplied with a quick connect coupling or a threaded union so that the respective inlets may be connected to water hoses 78 and 80. Alternatively, one water hose may be split by a "Y" connector and attached to the two inlets 46 and 68.

The rotary union 42 provides a seal between the stationary swivel chamber 36 and the rotating drill rods. This allows the drilling water to flow from the hose 78 attached to a drilling water inlet 46 on the swivel chamber 36 through the housing 40 and into the downstream drill rods. An internal sleeve 48 is mounted inside the rotary union 42 to match the internal diameter of the rotary union 42 with that of a drill rod and allow slideable access by a piston packing ring 50 circumscribing the wireline overshot 34.

The overshot 34 is located inside the swivel chamber 36 in such a manner as to initially position the piston packing ring 50 behind the drilling water inlet 46 toward the proximal end 52 of the swivel chamber 36. In this fashion pumped drilling water 54 from source 56 can flow into the drill rods without activating the overshot 34 by flowing around the solid overshot 34 and then into the rods.

The external diameter of the overshot 34 is slightly smaller than the diameter of the internal drill sleeve 48 so as to form an annulus 74 therebetween. The water 54 will first pass through the annulus 74 and then through the rod adapter 44 before coursing down the drill string to the drill bit.

A rear adapter 58 of the swivel chamber 36 is threaded to allow the attachment of a cable packing chamber 60 with a fluid leak resistant cable packing 62 inside. The wireline cable 30 is attached to an eye 64 affixed to the overshot 34 via a cable clamp 66. The cable 30 extends through the rear adapter 58 of the housing 40, the cable packing chamber 60 and the cable packing 62. Once outside the swivel chamber 36 the cable 30 is attached to the external winch 32.

When a particular drilling cycle is complete, the water to the drilling inlet 46 is closed and the retrieval water 70 is supplied from water supply 72 to the core retrieval inlet 68 via the hose 80. The drilling water inlet 46 and the core retrieval inlet 68 are spaced apart from one another. This allows the packing 50 of the overshot 34 to be initially internally positioned between the two inlets 46 and 68. In this position water pressure 70 is extended against the packing 50 which forces the overshot 34 out through the swivel chamber 36 and into the attached rod string. The overshot 34 is pushed along the inside of the rods until it contacts the full core retrieval tube disposed immediately above the drill bit in the hole. The water 70 will pass through the annulus 74 formed between the internal drill sleeve 48 and the overshot 34. At this point the forward motion of the overshot 34 is halted as it attaches to the core retrieval tube. The change in water pressure indicates when the attachment step has been completed. A pressure sensitive detector (not shown) provides an indicating signal that the linkage was successful.

The water supplied to the core retrieval inlet 68 is then shut off. The drill rod 24 located ahead of the swivel chamber 36 and the chuck rod 28 is unthreaded and the swivel chamber 36 is retracted with the rotation unit 14 to expose the collar of the rod string.

The winch 32 is then activated and the wireline cable 30 pulls the overshot 34 and core retrieval tube to the collar of the rod string. The overshot 34 is disconnected from the core retrieval tube and retracted back inside the swivel chamber 36 by the wireline cable 30. The full core tube is removed from the interior of the rods and an empty tube replaced inside the drill rod. An additional drill rod may be added to the rod string and the swivel chamber 36 is threaded to the drill rod or the chuck rod 28. The water is resupplied to the drilling water inlet 46 and the hydraulic pressure pushes the empty core retrieval tube back down the rod string to its core retrieval position above the bit.

The core retrieval cycle is now complete and the drilling operation can commence.

In accordance with the provisions of the statute, the specification illustrates and describes specific embodiments of the invention. Those skilled in the art will understand that changes may be made in the form of the invention covered by the claims; and that certain features of the invention may sometimes be used to advantage without a corresponding use of the other features.

The embodiments of the invention in which an exclusive property or privilege is claimed are defined as follows:

1. A swivel chamber adapted for use with an overshot having a predetermined diameter and an external packing and a drill rod, the swivel chamber comprising a hollow housing, the housing having a proximal end and a distal end, fluid leak resistant rotary coupling means affixed to the distal end of the housing, means for connecting the fluid leak resistant rotary coupling means to the drill rod, a first fluid inlet affixed to the housing and located towards the proximal end of the housing, a second fluid inlet affixed to the housing and located towards the distal end of the housing, a wireline cable packing means affixed to the proximal end of the housing, an annulus disposed between the overshot and the housing, and the swivel chamber mountable to a drill.

2. The swivel chamber according to claim 1 wherein the external packing of the overshot is situated between the first fluid inlet and the second fluid inlet.

3. The swivel chamber according to claim 1 wherein a wireline cable passes through the proximal end of the housing.

4. The swivel chamber according to claim 1 wherein an internal sleeve is disposed within the swivel chamber.

5. The swivel chamber according to claim 1 including at least one fluid supply means connected to the first fluid inlet and the second fluid inlet.

6. The swivel chamber according to claim 1 wherein a cable packing chamber is disposed at the end of the swivel chamber.

7. The swivel chamber according to claim 1 wherein the fluid leak resistant rotary coupling means is a rotary union.

8. A swivel chamber for use with a drill and a drill rod, the swivel chamber comprising an elongated hollow housing having a distal end and a proximal end, a rotary union connected to the distal end of the elongated hollow housing, the elongated hollow housing including two spaced fluid inlets, a fluid leak resistant packing affixed to the proximal end of the elongated hollow housing, a wire disposed within the elongated hollow housing and extending through the fluid leak resistant packing, the elongated hollow housing adapted to accommodate a movable overshot connected to the wire, means for connecting the switch chamber to the drill rod, and means for attaching the swivel chamber to the drill.

9. The swivel chamber according to claim 8 wherein the overshot is disposed therein.

10. The swivel chamber according to claim 9 wherein an internal annulus is present between the overshot and the housing.

11. The swivel chamber according to claim 9 wherein the overshot includes a packing ring disposed about the exterior of the overshot, and the packing ring disposed between the two spaced fluid inlets.

12. The swivel chamber according to claim 8 wherein at least one source of fluid is connected to the fluid inlets.

* * * * *